US009993383B2

(12) United States Patent
Hovenden et al.

(10) Patent No.: US 9,993,383 B2
(45) Date of Patent: Jun. 12, 2018

(54) DRAWER-MOUNTED SWING-OUT SHELF

(71) Applicant: A-dec, Inc., Newberg, OR (US)

(72) Inventors: David Anthony Hovenden, Salem, OR (US); Joshua D. Vail, Sherwood, OR (US)

(73) Assignee: A-dec, Inc., Newberg, OR (US)

( * ) Notice: Subject to any disclaimer, the term of this patent is extended or adjusted under 35 U.S.C. 154(b) by 0 days. days.

(21) Appl. No.: 15/092,519

(22) Filed: Apr. 6, 2016

(65) Prior Publication Data

US 2017/0290726 A1 Oct. 12, 2017

(51) Int. Cl.

| | |
|---|---|
| ***A61G 15/16*** | (2006.01) |
| ***A47B 46/00*** | (2006.01) |
| ***A47B 88/40*** | (2017.01) |
| ***A47B 49/00*** | (2006.01) |
| ***A47B 57/30*** | (2006.01) |
| ***A47B 81/00*** | (2006.01) |
| ***A61G 15/14*** | (2006.01) |
| ***A47B 88/919*** | (2017.01) |

(52) U.S. Cl.

CPC ..... *A61G 15/16* (2013.01); *A47B 46/00* (2013.01); *A47B 49/00* (2013.01); *A47B 49/004* (2013.01); *A47B 57/30* (2013.01); *A47B 81/00* (2013.01); *A47B 88/40* (2017.01); *A47B 88/919* (2017.01); *A61G 15/14* (2013.01); *A47B 2088/4015* (2017.01); *A47B 2210/03* (2013.01)

(58) Field of Classification Search

CPC ..... A61G 15/16; A61G 15/14; A47B 46/00; A47B 49/00; A47B 11/00; A47B 21/034; A47B 21/03; A47B 83/045; A47B 49/004; A47B 57/30; A47B 88/919; A47B 81/00; A47B 2088/4015; A47B 2210/03; A47B 88/40

USPC ..... 312/295, 310, 322, 238, 298, 325, 209, 312/311, 300, 302, 303; 108/103, 138, 108/140; 433/79; 248/282.1

See application file for complete search history.

(56) References Cited

U.S. PATENT DOCUMENTS

| | | | | |
|---|---|---|---|---|
| 1,934,370 A | | 11/1933 | Mirabella | |
| 2,819,141 A | * | 1/1958 | Myer | A47J 47/005 126/333 |
| 3,901,565 A | * | 8/1975 | Hagen | A47B 88/57 312/332 |
| 4,543,739 A | * | 10/1985 | Zerhoch | D06F 81/08 248/676 |
| 4,546,708 A | * | 10/1985 | Wilburth | A47B 11/00 108/103 |
| 4,733,618 A | * | 3/1988 | Sarro | A47B 21/0314 108/102 |
| 4,863,124 A | * | 9/1989 | Ball | A47B 21/00 108/28 |

(Continued)

OTHER PUBLICATIONS

Extended Search Report for European Patent Application No. 17165212.6 (dated Sep. 5, 2017).

*Primary Examiner* — Hiwot E Tefera

(74) *Attorney, Agent, or Firm* — Klarquist Sparkman, LLP

(57) ABSTRACT

A shelf assembly comprises a shelf, an arm having a distal end and a proximal end, a first pivot connection between the shelf and the distal end of the arm, and a second pivot connection between the proximal end of the arm and a base. The base comprises a drawer movable in translation between at least a storage position and an operating position. A cabinet for a swing-out shelf is also described.

14 Claims, 11 Drawing Sheets

(56) References Cited

U.S. PATENT DOCUMENTS

| | | | | |
|---|---|---|---|---|
| 7,585,033 | B2 * | 9/2009 | Holt | A47B 37/00 108/138 |
| 9,004,455 | B2 * | 4/2015 | Falcon | A47B 51/00 254/133 R |
| 9,441,784 | B2 * | 9/2016 | Russell | A47B 17/03 |
| 9,572,425 | B2 * | 2/2017 | Schulman | A47B 23/02 |
| 2003/0151336 | A1 | 8/2003 | Freeman | |
| 2004/0163687 | A1 * | 8/2004 | Son | A47L 15/506 134/58 D |
| 2005/0022699 | A1 * | 2/2005 | Goza | A47B 21/0314 108/50.01 |
| 2006/0156962 | A1 | 7/2006 | Holt | |
| 2007/0018545 | A1 * | 1/2007 | Calabria | A47B 77/10 312/311 |
| 2007/0028815 | A1 * | 2/2007 | Sommerfield | A47B 21/0314 108/103 |
| 2007/0159040 | A1 * | 7/2007 | Fernandez | A47B 88/90 312/348.3 |
| 2010/0159415 | A1 * | 6/2010 | Benfield | A61G 15/16 433/79 |
| 2010/0277047 | A1 * | 11/2010 | Sung | A47B 77/18 312/333 |
| 2015/0033786 | A1 * | 2/2015 | Mansfield | F25D 23/12 62/449 |
| 2016/0015170 | A1 * | 1/2016 | Schulman | A47B 23/02 108/91 |

* cited by examiner

DRAWER-MOUNTED SWING-OUT SHELF

FIELD

This application relates to dental equipment, and in particular to storage solutions for dental operating spaces.

BACKGROUND

Dentists, dental assistants and other practitioners continue to seek more efficient solutions for storing equipment and supplies used during treatment of patients. A typical dental operatory often has a limited footprint, so space must be used wisely. At the same time, practitioners must have ready access to items needed during treatment, and from a location that is selected to be convenient but minimize interference with movement of other equipment and personnel. In some settings, equipment and supplies are stored in cabinets, so it would be advantageous to make such cabinets more useful during treatment.

SUMMARY

Described below are implementations of a shelf assembly that addresses some of the drawbacks of current approaches to storing dental equipment and supplies.

According to a first implementation, a shelf assembly comprises a shelf member, an arm having a distal end and a proximal end, a first pivot connection between the shelf member and the distal end of the arm and a second pivot connection between the proximal end of the arm and a base. The base comprises a drawer movable in translation between at least a storage position and an operating position.

The shelf assembly can comprise a cabinet shaped to enclose the drawer, the arm and the shelf member when they are in a storage position.

The drawer can comprise at least two pre-defined mounting locations for mounting the arm. The drawer can comprise a mounting location for the arm defined at an inner corner of the drawer.

The drawer can comprise a central opening positioned at a level below the arm and the shelf member.

The shelf assembly can comprise a reinforcement bracket shaped to extend in orthogonal directions and having mounting holes for mounting the brackets at the mounting location.

The shelf assembly can be symmetrical about a center point and have two curved portions extending away from the center point in opposite directions.

In some implementations, at least one of the first or second pivot connections comprises a resistance adjustment member. In some implementations, at least one of the first or second pivot connections comprises an assembly of thrust bearings and thrust washers.

In some implementations, the drawer is movable between a retracted position and at least one extended position, and the drawer has detents at the retracted position and at the extended position.

In some implementations, the base is generally horizontal when the shelf assembly is installed.

The drawer can comprise a back that projects upwardly from the drawer. The back can restrict the shelf and arm from moving rearwardly beyond a selected storage position.

The back can comprise at least one magnet positioned to attract and hold the shelf member when the shelf member is in a storage position.

In some implementations, a cabinet can comprise at least a first level on which the drawer is movably mounted, and a second level on which a second drawer with a second arm and a second shelf is mounted.

In another implementation, a cabinet for dental supplies comprises first and second swing-out shelf members. The first swing-out shelf member is pivotably connected to a first arm having a proximal end pivotably connected to a first sliding drawer. The second swing-out shelf member is pivotably connected to a second arm having a proximal end pivotably connecting to a second drawer. The second drawer is vertically spaced from the first drawer. The cabinet also comprises a cabinet housing sized to house the first and second drawers.

In some implementations, at least one of the first swing-out shelf member or the second swing-out shelf member has a contoured forward edge.

In some implementations, the proximal end of the first arm is mounted to the first drawer adjacent a first corner, and wherein a second corner positioned opposite the first corner is pre-drilled with mounting holes for an alternative mounting position for the arm.

At least the first drawer can comprise an L-shaped reinforcement bracket with legs oriented orthogonally along intersecting sides of the first drawer to distribute a load from the first arm and reduce deflection in the first drawer. At least the first drawer can comprise a back positioned to extend uprightly from a rear side of the first drawer.

The foregoing and other features and advantages will become more apparent from the following detailed description, which proceeds with reference to the accompanying figures.

DETAILED DESCRIPTION

Figure 1:
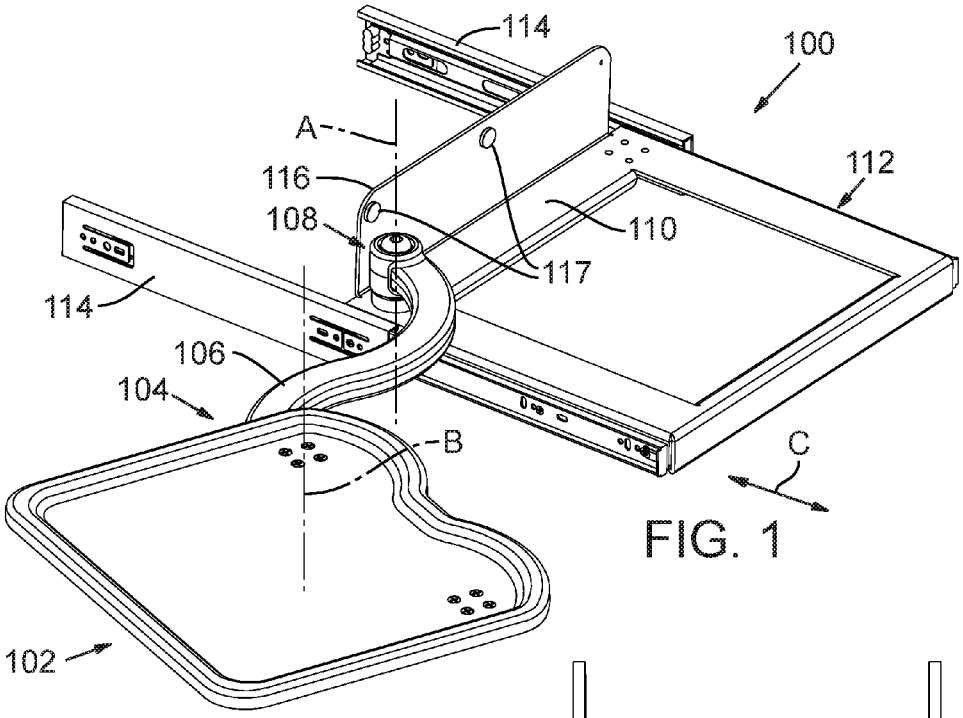
FIG. 1 is a perspective view showing a shelf assembly during use with the shelf in a use position and the drawer extended.

Referring to FIGS. 1-4, a shelf assembly 100 is shown in one possible use position with a shelf member 102 in an extended or deployed position and connected by an arm 106 to a base 110. In the illustrated implementation, the base 110 is part of a sliding drawer or tray 112 that is movable in translation, such as along axis C, from a closed position to an open or extended position. Specifically, the shelf member 102 is pivotably connected to a distal end of the arm 106 at a first pivot connection 104 (axis B). The arm has a proximal end that is pivotably connected at a second pivot connection 108 (axis A) to the base 110. Stated differently, the shelf member 102 can be "swung out."

In some implementations, the shelf member 102 can be pivoted 360 degrees relative to the first pivot connection 104 (subject to the presence of any interfering structure). In some implementations, the arm 106 can be pivoted 360 relative to the second connection 108 (subject to the presence of any interfering structure). As illustrated, the shelf member 102 and the arm 106 are configured such that the shelf member 102 can be rotated 360° about the pivot connection 104 (for at least for some positions of the arm 106 relative to the second pivot connection 108), subject to other objects that may be present and interfere with such rotation. In other implementations, it may be possible to configure the arm 106 with only the pivot connection 108.

The arm 106 can be described as S-shaped. In the illustrated implementation, the arm is symmetrical about its center point, although such a symmetry is not a requirement. Further, the S-shape in the illustrated implementation is comprised of smoothly curving segments, but it would also be possible to achieve an arm having a distal end offset from its pivot point by a desired distance using one or more angled or curved segments. Because the distal end of the arm 106 is offset, the arm 106 can be swung out or extended farther than a straight arm.

Figure 5:
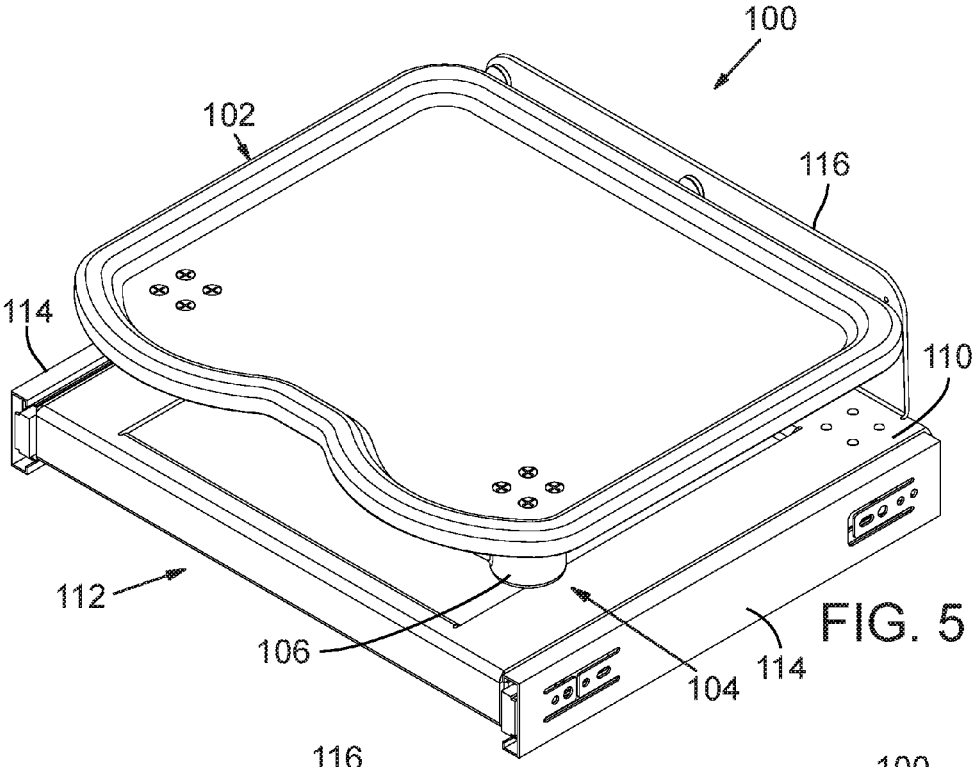
FIG. 5 is a perspective view of the shelf assembly with the shelf in a storage position and the drawer retracted.

In the illustrated implementation, the drawer 112 is configured to translate between multiple positions, such as at least an open position (e.g., as shown in FIG. 1) and a closed position (e.g. as shown in FIG. 5). In the illustrated implementation, the drawer is slidably supported using conventional drawer slides 114. The drawer slides 114 may be configured to provide defined positions for the drawer 112, such as one or more predefined open or extended positions and/or closed or retracted positions. Of course, it would be possible to provide other predefined positions as well.

In the illustrated implementation, there is a back 116 attached to the drawer 112 and projecting upwardly from the drawer 112. The back 116 fulfills several functions, including preventing the shelf member 102 and arm 106 from being pushed rearwardly beyond a pre-defined storage position, such as is shown in FIG. 5. In some implementations, the back is fitted with one or more magnets (e.g., three magnets, with two such magnets 117 being shown (see FIG. 1)).

The drawer 112 may be provided with a central opening 118. The opening 118 can be fitted with one or more removable members, including a set of containers providing storage for various items of different sizes.

Figure 9A:
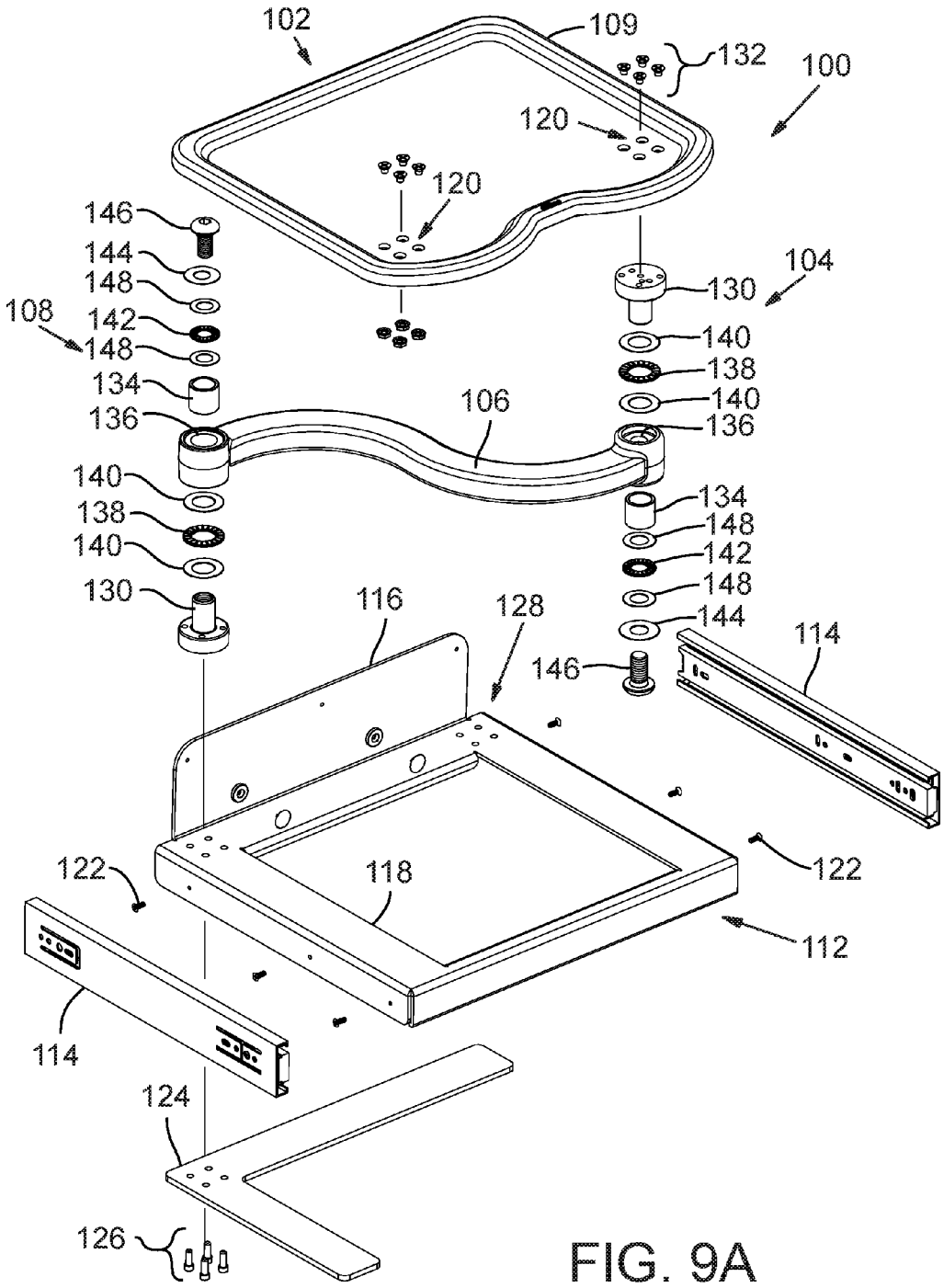
FIG. 9A is an exploded perspective view of the shelf assembly.

The shelf member 102 can be designed to have any desired size. In some implementations, the shelf member 102 is designed to accommodate a tub or tray, but other sizes and purposes are, of course, possible. For example, the shelf member 102 can accommodate an instrument or piece of equipment that is swung into position when needed. Desirably, the shelf member 102 has a low profile and can be configured with one more structural features (such as a surrounding rib 109 as best seen in FIG. 9A) that increase its stiffness under load.

In some implementations, the shelf member 102 has a formed steel construction. The shelf member 102 can have surfaces that are smoothly joined together, including in the area of the rib 109, which makes cleaning of the shelf member easier.

Figure 2:
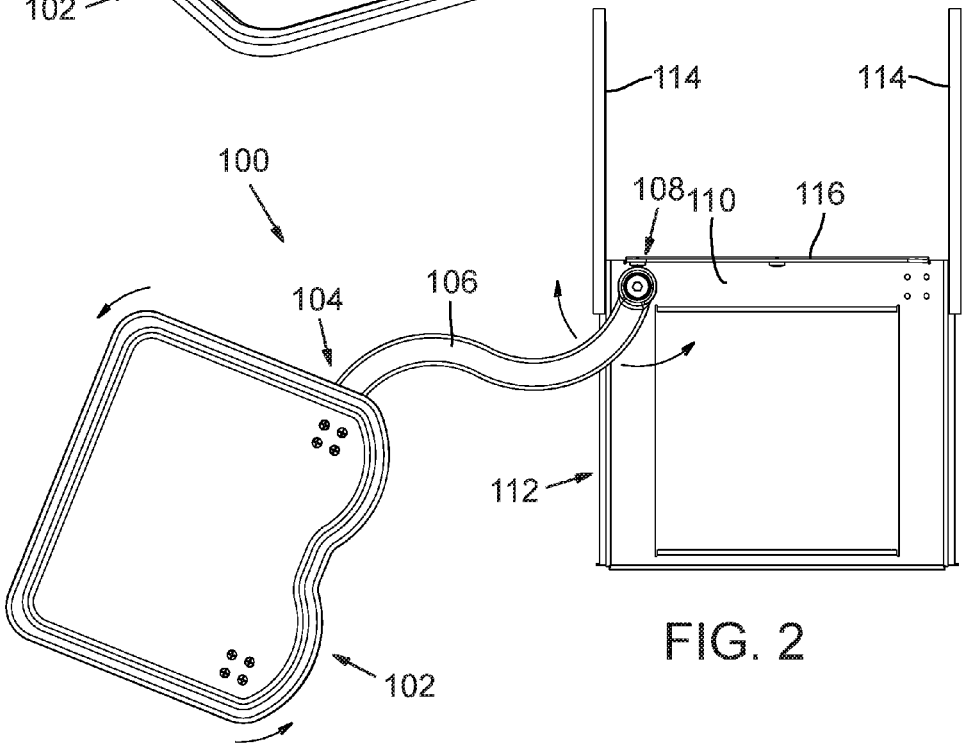
FIGS. 2, 3 and 4 are top plan, front elevation and side elevation views, respectively, of the shelf assembly of FIG. 1.
Figure 3:
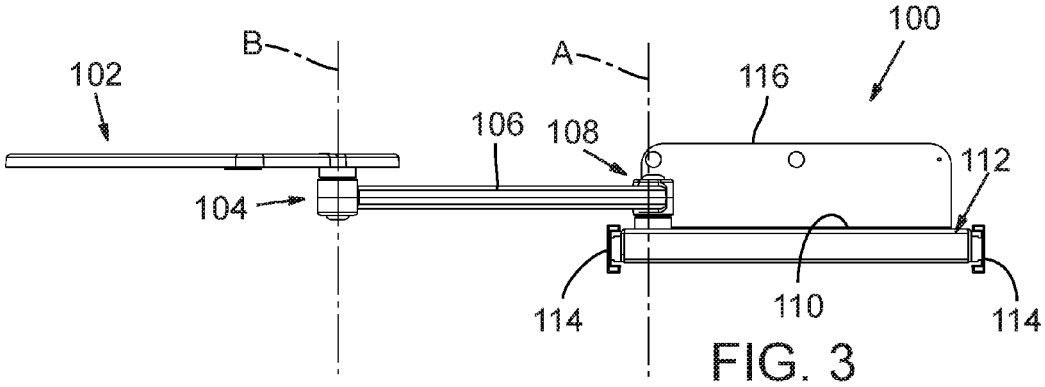
Figure 4:
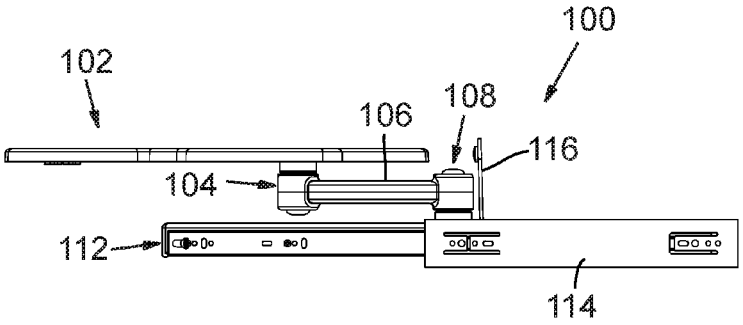

As shown in FIG. 2, which is a top plan view, and FIG. 3, which is a side elevation view, the shelf member 102 is potentially extendable to a considerable distance. Thus, to the extent that the shelf member 102 is subjected to a load, the load can be exerted over a moment arm having considerable length. Therefore, the structure of the shelf member 102, the arm 106, the first pivot connection 104, the second pivot connection 108 and the drawer 112 have been carefully designed to minimize deflection and ensure robust performance. For example, in some implementations the assembly is designed to meet ANSI/AAMI ES60601-1:2005/(R)2012 Clause 9.8.2 (Tensile Safety Factor).

Figure 9B:
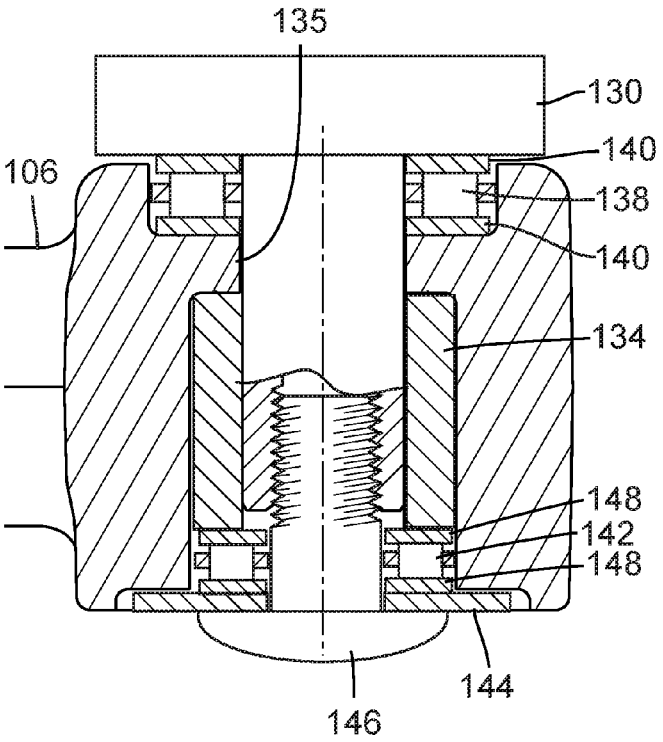
FIG. 9B is a section view in elevation of one end of the arm.
Figure 9C:
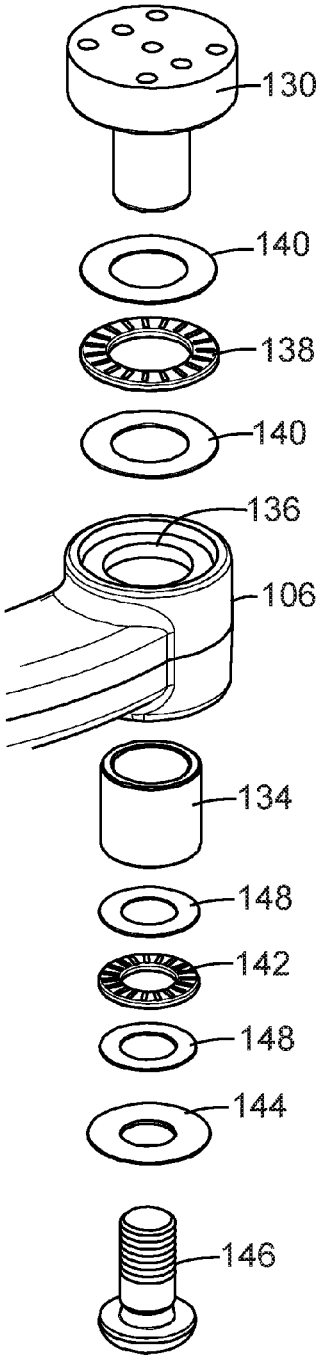
FIG. 9C is a magnified view of a portion of FIG. 9A.
Figure 9D:
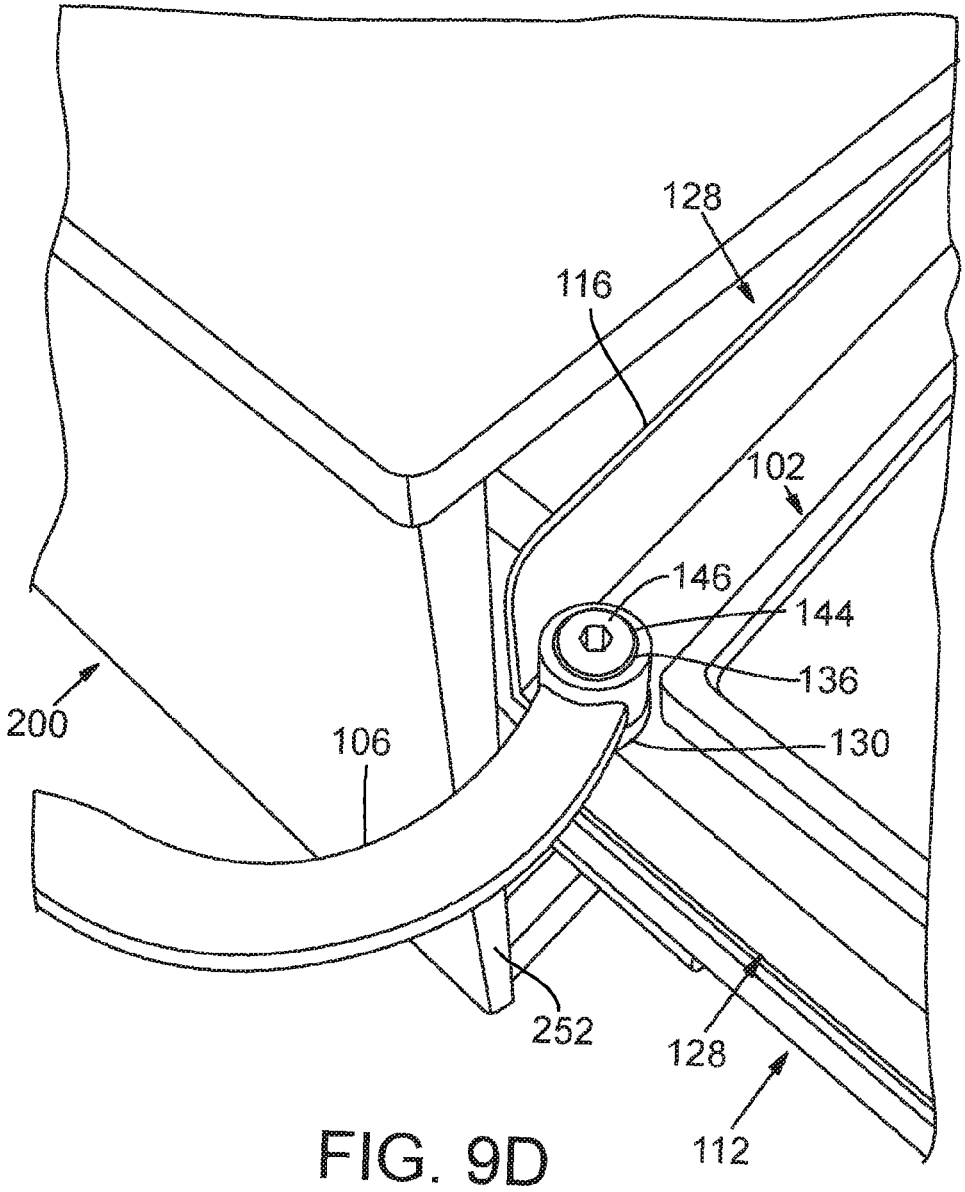
FIG. 9D is a partial perspective view to show the reach of the arm when pivoted to a maximum extent into contact with a cabinet while the drawer is extended.

Referring to FIG. 9D, in some implementations, the arm 106 is configured to pivot until it contacts the cabinet (such as the cabinet edge banding 252) when the drawer 112 is fully extended. This maximizes the reach of the arm 106, especially in a lateral direction.

Figure 6:
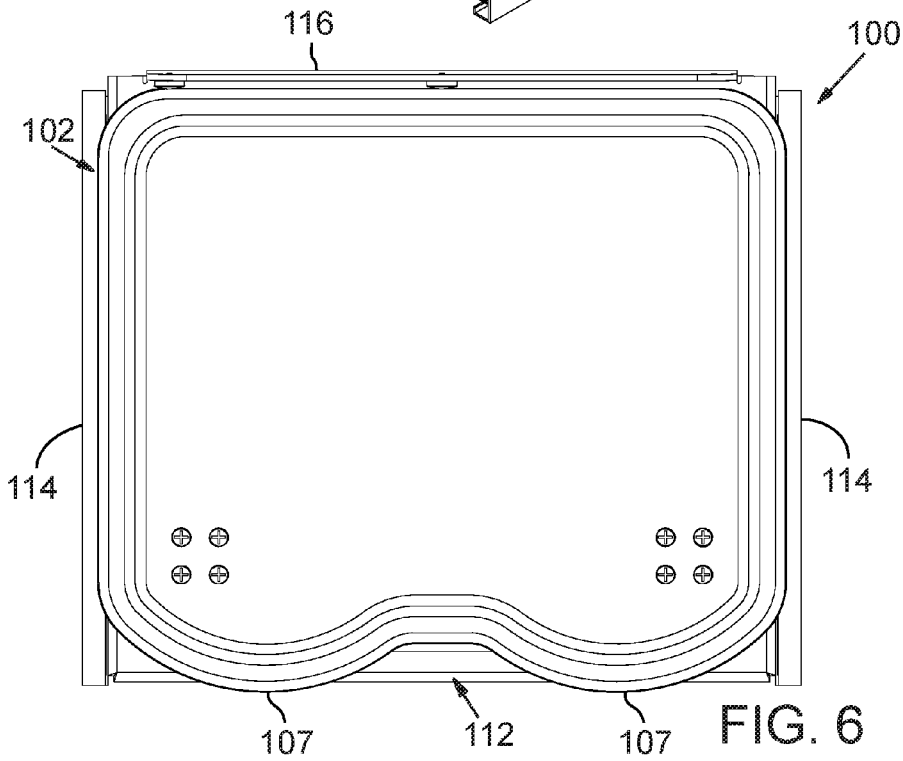
FIGS. 6, 7 and 8 are top plan, front elevation and side elevation views, respectively, of the shelf assembly of FIG. 5.
Figure 7:
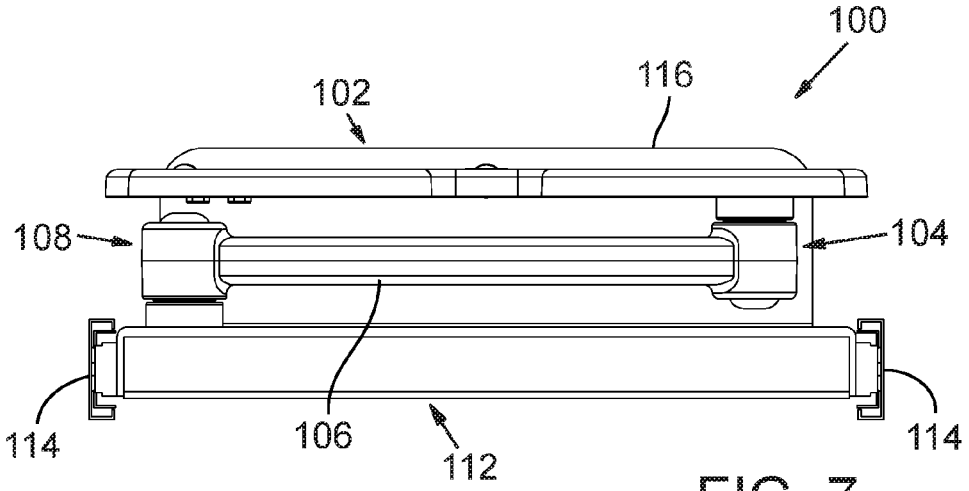
Figure 8:
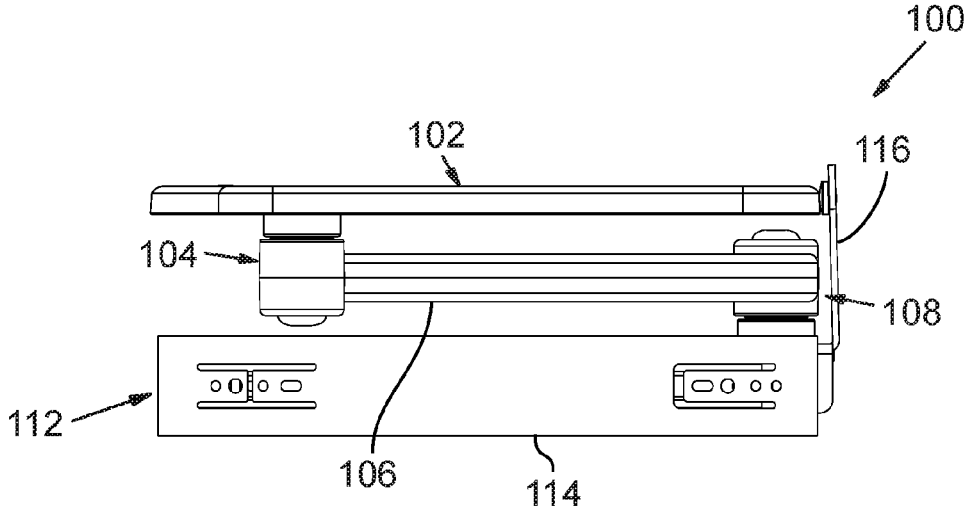

FIGS. 5-8 show the shelf assembly 100 configured in a storage position in which the shelf member 102 has been moved over the drawer 112 with the arm 106 pivoted to extend diagonally between the pivot connection 108 and the second pivot connection 104, and at a height above the drawer 112, as best seen in FIGS. 7 and 8. In the illustrated implementation, the shelf member 102 is sized such that it can be slid out from a cabinet or other enclosure, as discussed below in more detail.

As shown in FIG. 6, a front edge of the shelf member 102 is contoured to provide one or more curved sections 107, e.g., adjacent each corner, that are easy for a user to reach and grasp to move the shelf member 102 to a different position.

FIG. 9A is an exploded view of the shelf assembly 100. As shown, the shelf member 102 can have a generally planar surface, and may be fitted with a surrounding raised edge 109 to allow it to be gripped easily and to help retain any small items. As shown, the shelf member 102 may be provided with multiple pre-defined mounting locations such as the two opposing mounting locations 120. In the illustrated implementation, one of the mounting locations 120 is aligned with the distal end of the arm 106 and assembled together with a number of components that together form the pivot connection 104.

In one specific implementation, the shelf member 102 is attached with threaded fasteners 132 to a pivot hub 130, which is received in a bearing 134 that sits within a bore 135 in the arm 106. The bore 135 is best shown in FIG. 9B, which shows a section view of the distal end of the arm at the pivot connection 104 in elevation.

In addition to the pivot hub 130 and the bearing 134, the pivot connection 104 also includes a thrust bearing 138, thrust washers 140 positioned above and below the thrust bearing 138, and, below the arm 106, a thrust bearing 142, thrust washers 148 positioned above and below the thrust bearing 142, a flat washer 144 and a cap screw 146 that can be rotated to adjust the pivot resistance.

It would, of course, be possible to use one or more different components for the pivot connection 104 than described above for the illustrated implementation. As just one example, one or more of the separate bearings described above could be omitted or combined with other components.

At the opposite corner of the shelf member 102, the unused mounting location 120 can be fitted with fasteners, such as mounting bolts and nuts that close the holes in the shelf member and provide for a more finished appearance.

As can be seen in FIG. 9A, the same components of the pivot connection 104 are used for the pivot connection 108 at the proximal end of the arm 106 and the base or drawer 112. Thus, there is a second pivot hub 130 mounted to the drawer 112 with fasteners 126, and the same bearings and washers as described above are assembled together and held in place by the engagement of the cap screw 146 with the pivot hub 130.

In the illustrated implementation, the pivot connection 108 can be further reinforced with an optional bracket 124 that is secured by the fasteners 126 and extends generally along two orthogonal edges of the bottom surface of the drawer 112. As can be seen, the drawer slides 114 are attached to opposite sides of the drawer 112 with fasteners 122. In some implementations, drawer slides sold by Accuride can be used.

FIGS. 10-13 show a cabinet assembly 200 that incorporates two instances of the shelf assembly (see, e.g., shelf assembly 100 in FIG. 1) and illustrate how they can be used in tandem.

Figure 10:
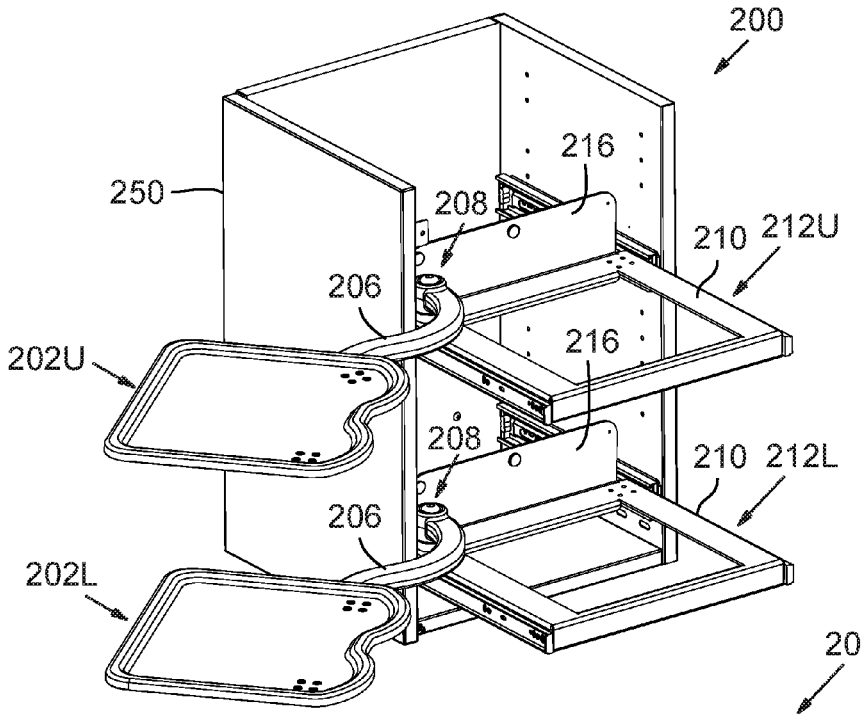
FIG. 10 is a perspective view of a cabinet showing upper and lower shelf assemblies in respective use positions with drawers extended.
Figure 11:
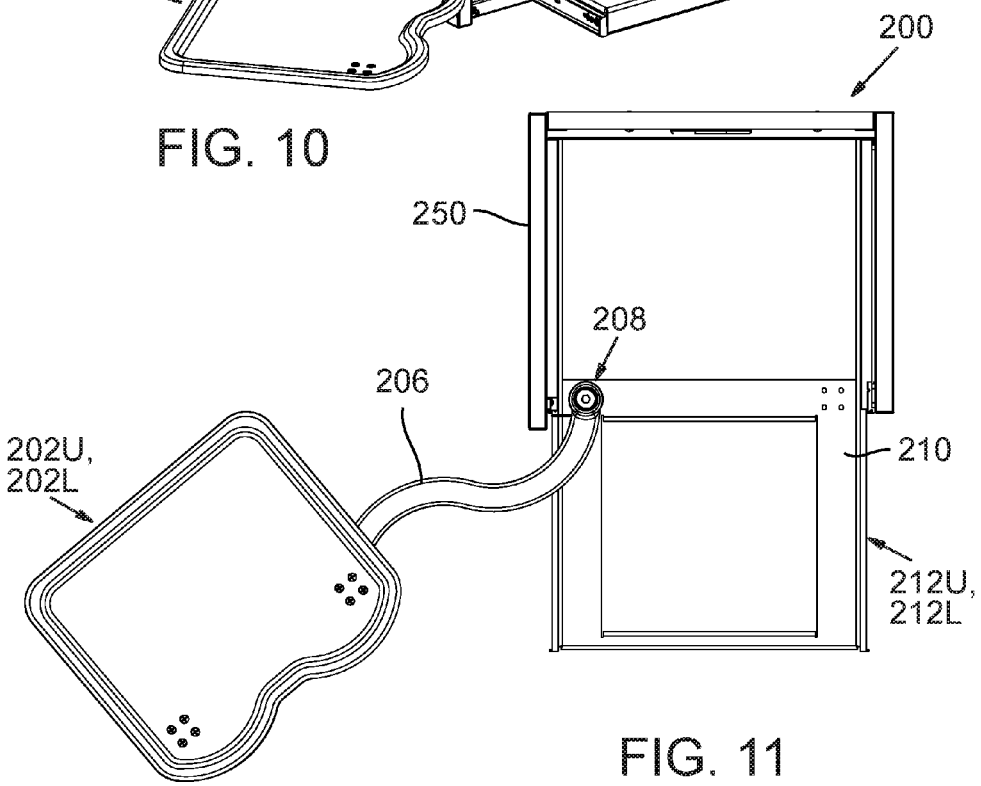
FIGS. 11, 12 and 13 are top plan, front elevation and side elevation views, respectively, of the cabinet of FIG. 10.

FIG. 10 is a perspective view showing the cabinet assembly 200 with an upper shelf member 202U extended and the upper drawer 212U extended from a cabinet 250. Similarly, a lower shelf assembly is shown with the lower shelf member 202L extended and the drawer 212L extended. In the illustrated implementation, the two shelf assemblies are mounted to the extendable from a same side of the cabinet, but it would also be possible to have shelf assemblies mounted to opposite sides of the cabinet 200. It is course possible to use only a single shelf assembly with the cabinet assembly 200. Also, the height at which any of the shelf assemblies is positioned within the cabinet is adjustable.

Figure 12:
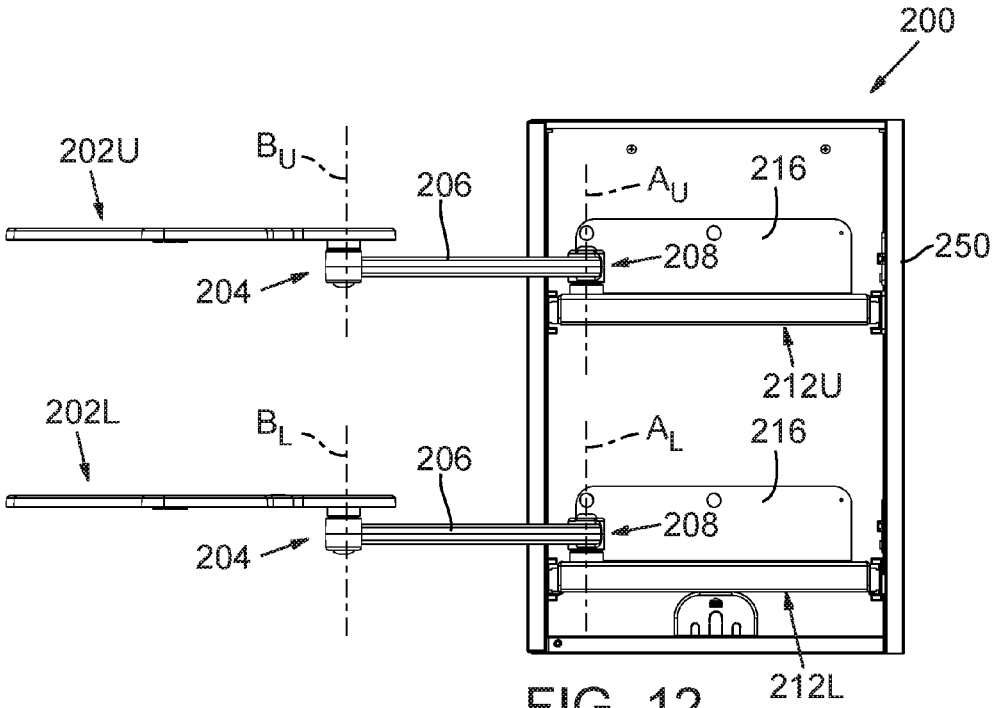
Figure 13:
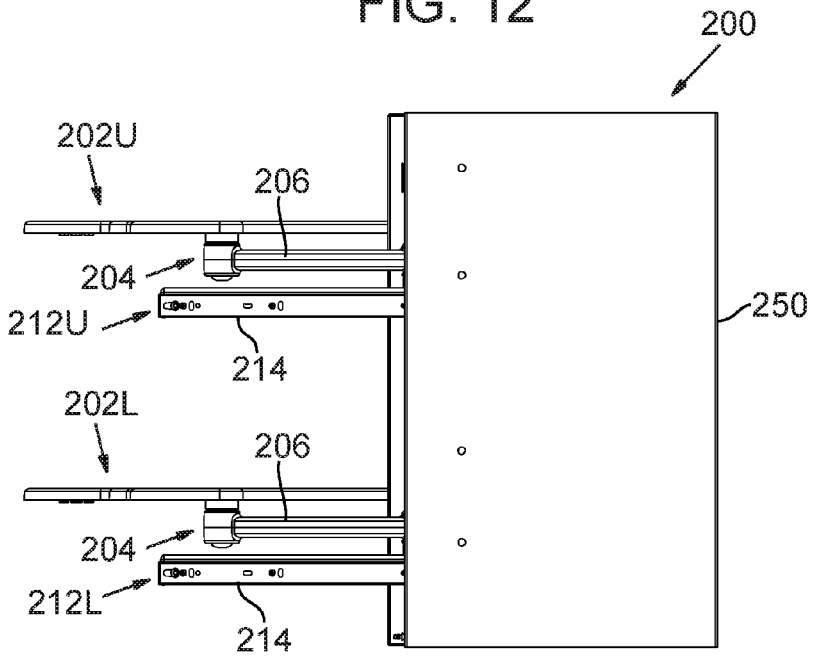
Figure 14:
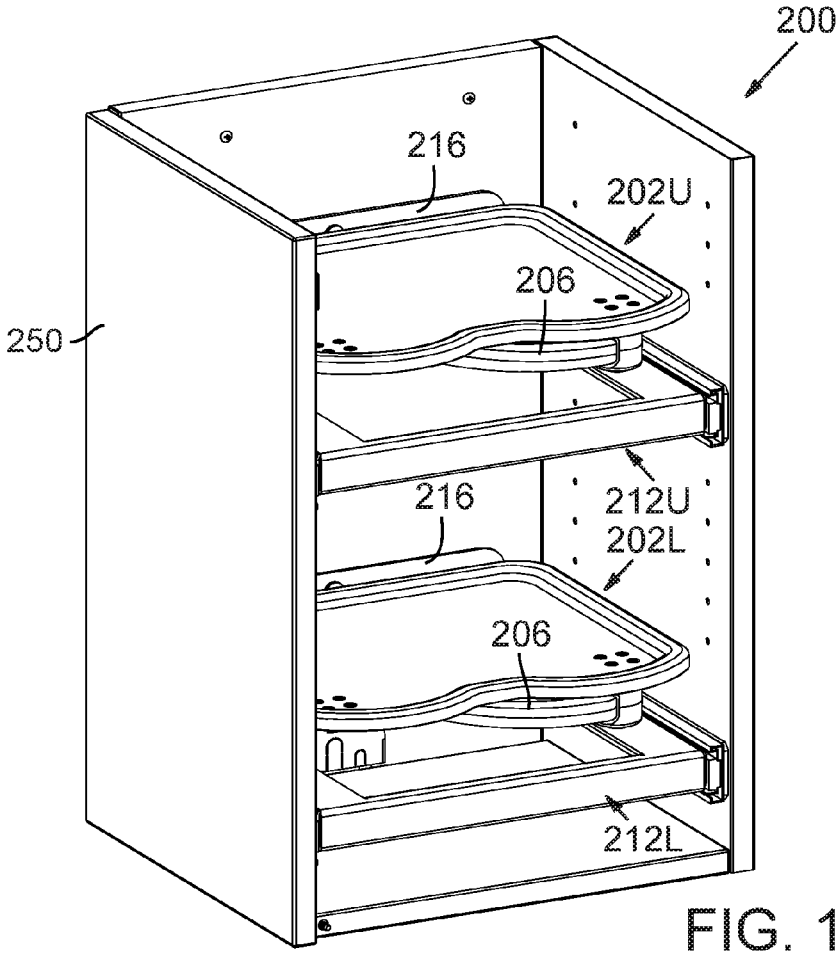
FIG. 14 is a perspective view of the cabinet showing upper and lower shelf assemblies in storage positions.
Figure 15:
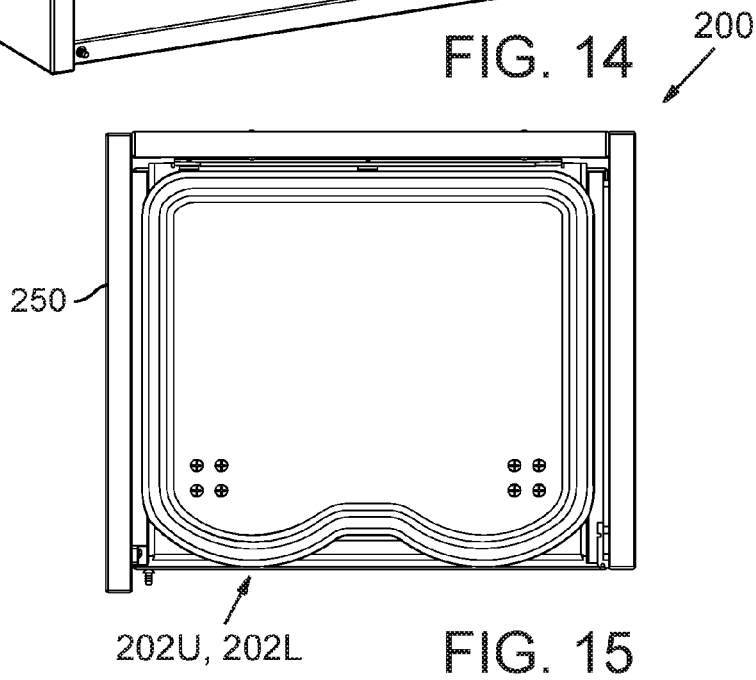
FIGS. 15, 16 and 17 are top plan, front elevation and side elevation views, respectively, of the cabinet of FIG. 14.
Figure 16:
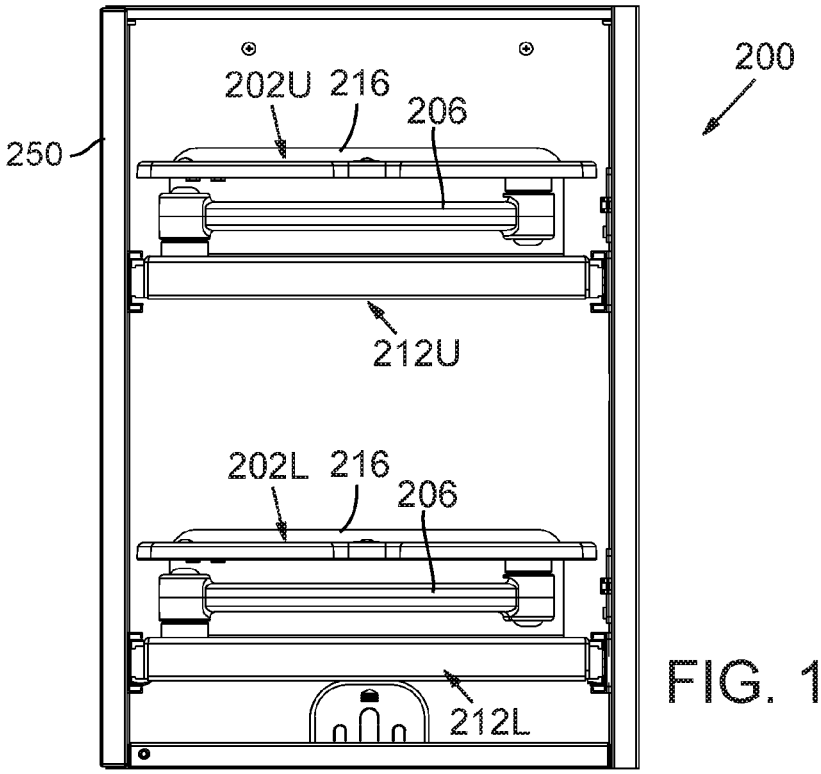
Figure 17:
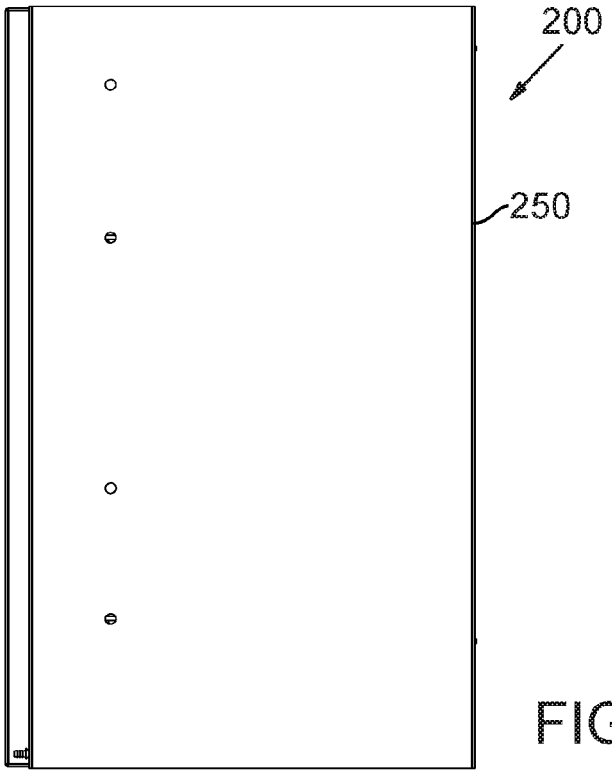

In FIG. 12, it can be seen that there is a pivot axis $A_U$ for the upper shelf assembly that is directly aligned with a pivot axis $A_L$ for the lower shelf assembly. Similarly, there is an upper pivot axis $B_U$ that is directly aligned with a lower pivot axis $B_L$ for the lower shelf assembly. Each of the shelf assemblies in FIGS. 10-13 is independently movable between its storage position and a full range of operating positions.

FIGS. 14-17 show the shelf assembly 200 with each of the shelf units 202U, 202L folded into a storage position and with the respective drawers 212U, 212L retracted. The cabinet 250 as illustrated has hinges for a cabinet door, but the door has not been shown for purposes of illustration.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A shelf assembly, comprising:

a shelf member;

an arm having a distal end and a proximal end;

a first pivot connection defining a first pivot axis between the shelf member and the distal end of the arm;

a second pivot connection defining a second pivot axis between the proximal end of the arm and a drawer, wherein the drawer is for positioning horizontally and is movable in translation between at least a storage position and an operating position, and wherein the first and second pivot axes are vertical when the drawer is positioned horizontally; and a reinforcement bracket coupled to the drawer and having first and second portions that are perpendicular to each other and extending laterally along perpendicular sides of the drawer, the reinforcement bracket having mounting holes for mounting the bracket in alignment with the second pivot axis.

2. The shelf assembly of claim 1, further comprising a cabinet shaped to enclose the drawer, the arm and the shelf member in a storage position.

3. The shelf assembly of claim 1, wherein the drawer comprises at least two pre-defined mounting locations for mounting the arm.

4. The shelf assembly of claim 1, wherein the drawer comprises a mounting location for the arm defined at an inner corner of the drawer.

5. The shelf assembly of claim 1, wherein the drawer comprises a central opening positioned below the arm and the shelf member.

6. The shelf assembly of claim 1, wherein the shelf member is sized to accommodate a standard dental tray.

7. The shelf assembly of claim 1, wherein the arm is S-shaped.

8. The shelf assembly of claim 1, wherein at least one of the first or second pivot connections comprises a resistance adjustment member.

9. The shelf assembly of claim 8, wherein the at least one of the first or second pivot connections comprises an assembly of thrust bearings and thrust washers.

10. The shelf assembly of claim 1, wherein the drawer is movable between a retracted position and at least one extended position, and wherein the drawer comprises detents at the retracted position and at the extended position.

11. The shelf assembly of claim 1, wherein the reinforcement bracket is coupled to a lower side of the drawer.

12. The shelf assembly of claim 1, wherein the drawer comprises a back that projects upwardly from the drawer, and wherein the back restricts the shelf and arm from moving rearwardly beyond a selected storage position.

13. The shelf assembly of claim 12, wherein the back comprises at least one magnet positioned to attract and hold the shelf member when the shelf member is in a storage position.

14. The shelf assembly of claim 2, wherein the cabinet comprises at least a first level on which the drawer is movably mounted, further comprising a second level on which a second drawer with a second arm and a second shelf is mounted.

* * * * *